US007602265B2

(12) United States Patent
Deligianni et al.

(10) Patent No.: US 7,602,265 B2
(45) Date of Patent: Oct. 13, 2009

(54) APPARATUS FOR ACCURATE AND EFFICIENT QUALITY AND RELIABILITY EVALUATION OF MICRO ELECTROMECHANICAL SYSTEMS

(75) Inventors: Hariklia Deligianni, Tenafly, NJ (US); Robert D. Edwards, Marlboro, NY (US); Thomas J. Fleischman, Poughkeepsie, NY (US); Robert A. Groves, Highland, NY (US); Charles J. Montrose, Clintondale, NY (US); Richard P. Volant, New Fairfield, CT (US); Ping-Chuan Wang, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 408 days.

(21) Appl. No.: 11/163,485

(22) Filed: Oct. 20, 2005

(65) Prior Publication Data

US 2007/0090902 A1 Apr. 26, 2007

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,016,092 A * 1/2000 Qiu et al. ..... 333/262
6,440,767 B1 * 8/2002 Loo et al. ..... 438/52
6,624,720 B1 * 9/2003 Allison et al. ..... 333/105
6,888,420 B2 * 5/2005 Schaffner et al. ..... 333/101

* cited by examiner

*Primary Examiner*—Lincoln Donovan
*Assistant Examiner*—Bernard Rojas
(74) *Attorney, Agent, or Firm*—DeLio & Peterson, LLC; Robert Curcio; Lisa U. Jacklitsch

(57) ABSTRACT

The present invention provides multiple test structures for performing reliability and qualification tests on MEMS switch devices. A Test structure for contact and gap characteristic measurements is employed having a serpentine layout simulates rows of upper and lower actuation electrodes. A cascaded switch chain test is used to monitor process defects with large sample sizes. A ring oscillator is used to measure switch speed and switch lifetime. A resistor ladder test structure is configured having each resistor in series with a switch to be tested, and having each switch-resistor pair electrically connected in parallel. Serial/parallel test structures are proposed with MEMS switches working in tandem with switches of established technology. A shift register is used to monitor the open and close state of the MEMS switches. Pull-in voltage, drop-out voltage, activation leakage current, and switch lifetime measurements are performed using the shift register.

3 Claims, 7 Drawing Sheets

APPARATUS FOR ACCURATE AND EFFICIENT QUALITY AND RELIABILITY EVALUATION OF MICRO ELECTROMECHANICAL SYSTEMS

BACKGROUND OF THE INVENTION

1. Field of the Invention

The invention relates to micro electromechanical systems, particularly to micro electromechanical switches and structures for testing the same. More specifically, the invention relates to test structures and test methods to acquire reliability and qualification data in order to characterize MEMS switch performance with statistical significance.

2. Description of Related Art

Micro Electromechanical Systems (MEMS) are being considered for possible switch structures in advanced high performance analog circuitry, in part, because of the improved switching characteristics over FET devices. For example, some MEMS-based RF switches are being developed with superior RF switching characteristics compared to other transistor-based switches, such as GaAs MESFETs, and the like.

While the development of these MEMS switches are in the early development stage, their performance must be empirically characterized; however, reliability and qualification methods for process enhancements and lifetime predictions are difficult to apply and require large sample sizes for accurate statistical determination.

In the qualification of MEMS relays, it is necessary to assess the overall performance of certain parameters including the degradation of performance over the life of the switch. These parameters will require quantitative measures with accompanying statistics in order to ascertain their longevity and reliability with statistical significance. Critical relays characteristics, such as activation and deactivation at certain activation/deactivation voltages, can be conveniently measured in a pass/fail fashion with the circuit design tolerance taken into account. These results are analyzed by plotting the cumulative fail in percentage versus lifetime under test in a lognormal scale. A statistical statement on the projected failure rate in normal operating lifetime can be obtained with an assigned level of confidence. In order meet higher and higher levels of reliability, statistical statements must be made with high precision and confidence. This means a larger amount of samples must be used in such test sequence.

Generally, the layout and fabrication of the MEMS devices makes the testing of large sample sizes impractical. For example, since each switch has at least four probe pads (two for the actuation and two for the contacts), an adequate sample size of switches would require either an extremely large number of I/O pads on the sample chip, or conversely, a large number of chips. These options quickly become expensive and impractical.

SUMMARY OF THE INVENTION

Bearing in mind the problems and deficiencies of the prior art, it is therefore an object of the present invention to provide an apparatus and method for testing MEMS relay devices using characteristic parameters to limit sample sizes and the number of I/O pads.

It is another object of the present invention to provide an apparatus and method for testing MEMS relay devices that accommodates the testing of a large number of devices and provides accurate measurements for certain device parameters.

A further object of the invention is to provide an apparatus for testing multiple MEMS switches on a semiconductor circuit chip without requiring a large number of probe pads.

Still other objects and advantages of the invention will in part be obvious and will in part be apparent from the specification.

The above and other objects, which will be apparent to those skilled in the art, are achieved in the present invention, which is directed to an apparatus for measuring contact and gap characteristics of MEMS switches comprising: a plurality of the MEMS switches in an array pattern configured in a serpentine circuit, having air gaps between combs of upper and lower actuation electrodes; a first pair of probe pads electrically connecting to the upper actuation electrodes; a second pair of probe pads electrically connecting to the lower actuation electrodes; and a third pair of probe pads electrically connecting to the MEMS switches in the serpentine circuit; such that all of the actuation electrodes are electrically configured in parallel, while the MEMS switches are electrically configured in series. Switch contacts of the MEMS switches may be arranged such that the MEMS switches close in series and the actuation electrodes in parallel so that an actuation leakage current which is a sum total of each individual actuation leakage current of each of the MEMS switches is measurable, or a contact resistance which is a sum total of each individual contact resistance of each of the MEMS switches is measurable.

In a second aspect, the present invention is directed to an apparatus for measuring characteristics of MEMS switches arranged in a cascaded electrical configuration comprising: a plurality of the MEMS switches, each of the MEMS switches having a signal line, a beam, and at least one actuation line; and via connections electrically connecting the signal line of a MEMS switch to the beam of an adjacent MEMS switch such that the plurality of MEMS switches are electrically linked to form a cascading chain when the actuation lines are biased; whereby, upon biasing the actuation lines of a first MEMS switch, biasing of each the adjacent MEMS switches is induced in a time delayed, linear fashion, until all of the plurality of MEMS switches are activated. The switch contacts of the MEMS switches are arranged to close in a cascading pattern so that a switch delay time which is a sum total of each individual switch delay time of the MEMS switch is measurable. The apparatus further comprises a frequency counter, an invertor, and an edge counter to form a ring oscillator of the MEMS switches arranged in the cascaded configuration, wherein the frequency counter yields a measurement of switch delay equal to a reciprocal of a product of frequency and number of the MEMS switches, satisfying an expression $1/f*N$, and the edge counter counts rising and falling edges of a transmitted signal through the MEMS switches, the transmitted signal electrically circling back the cascading chain to reopen the MEMS switches. Moreover, the apparatus may further include having each of the MEMS switch signal lines connected to an adjacent MEMS switch actuator line, each of the beams being resistively connected to a voltage potential, and having a ring initiation pulse inputted to a first actuator line of a first MEMS switch in the cascading configuration.

In a third aspect, the present invention is directed to an apparatus for measuring characteristics of MEMS switches using a resistor ladder comprising: a plurality of the MEMS switches; a plurality of resistors electrically configured such that each resistor has a corresponding MEMS switch, the resistor electrically connected in series with the MEMS switch, each resistor-MEMS switch pair electrically configured in parallel to one another; an actuation probe pad pair for applying an activation voltage; and a signal probe pad pair for collectively measuring output resistance of the resistor-MEMS switch pairs; such that when all of the MEMS switches are activated together, each of the MEMS switches close, one-by-one, incrementally decreasing measured resistance. Each of the plurality of resistors may have a different resistance values from one another, or an equivalent resistance value.

In a fourth aspect, the present invention is directed to an apparatus for measuring characteristic parameters of switches, comprising: a first set of switches comprised of a first technology; a second set of switches comprised of a second technology, the second technology different from the first technology; an actuation circuit in electromagnetic communication with the first set of switches; and a pair of actuation probe pads terminating the actuation circuit; wherein the first set of switches are configured in a closed-state and aligned in a series circuit when voltage is applied across the pair of actuation pads and the second set of switches are electrically held in an open-state, enabling a sum total contact resistance to be measured for the first set of switches or an open-state failure detected from at least one switch of the first set of switches. The second set of switches may be in a closed-state, electrically configuring the first set of switches in parallel, enabling a closed-state failure from at least one switch of the first set of switches when the first set of switches are activated to remain open. The first set of switches activates simultaneously when voltage is applied to the actuation pads. The first technology may include MEMS structure, while the second technology may include solid-state structure.

In a fifth aspect, the present invention is directed to an apparatus for increasing a MEMS switch sample size for quality assurance testing, comprising: a plurality of MEMS switches; an actuation circuit in electromagnetic communication with the plurality of MEMS switches, such that when the actuation circuit is activated at predetermined voltage levels, the MEMS switches are opened or closed; a shift register having a readout port and a plurality of data input registers, each of the data input registers corresponding to a MEMS switch of the plurality of MEMS switches, such that each of the data input registers is electrically in series with each of the MEMS switches, completing a series circuit when the MEMS switches are in a closed-state; and an electrical clock-pulse input to the shift register; wherein an open or close state of each of the plurality of MEMS switches is determined via a readout line of clock pulses from the shift register. An open/close status of each of the MEMS switches is determined from the shift register readout. The predetermined voltage comprises a step function of increasing voltage levels such that the shift register readout determines a pull-in voltage for each of the MEMS switches. Alternatively, the predetermined voltage comprises a step function of decreasing voltage levels such that the shift register readout determines a drop-out voltage for each of the MEMS switches.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-13 of the drawings in which like numerals refer to like features of the invention.

Figure 1A:
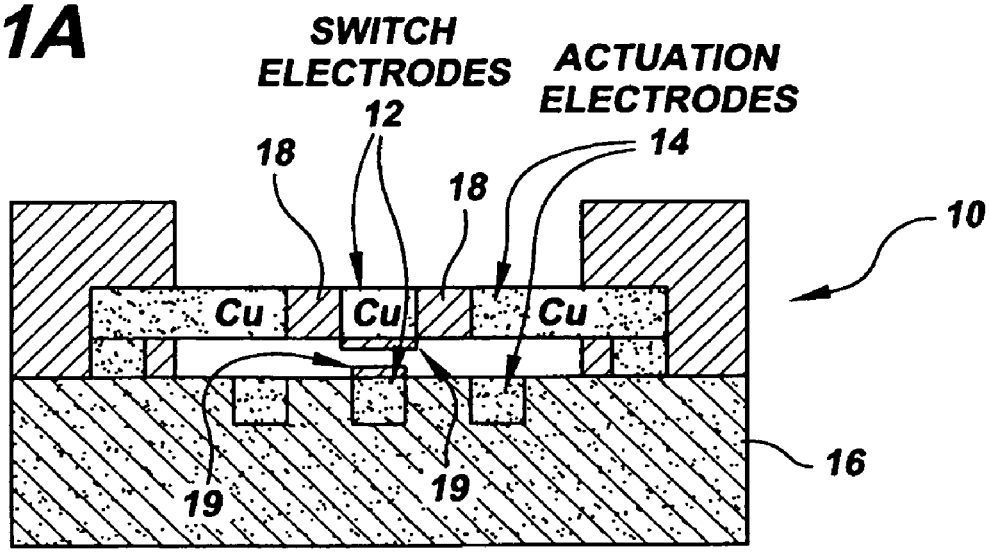
FIG. 1A depicts a MEMS relay in the OPEN state having switch electrodes and actuation electrodes.
Figure 1B:
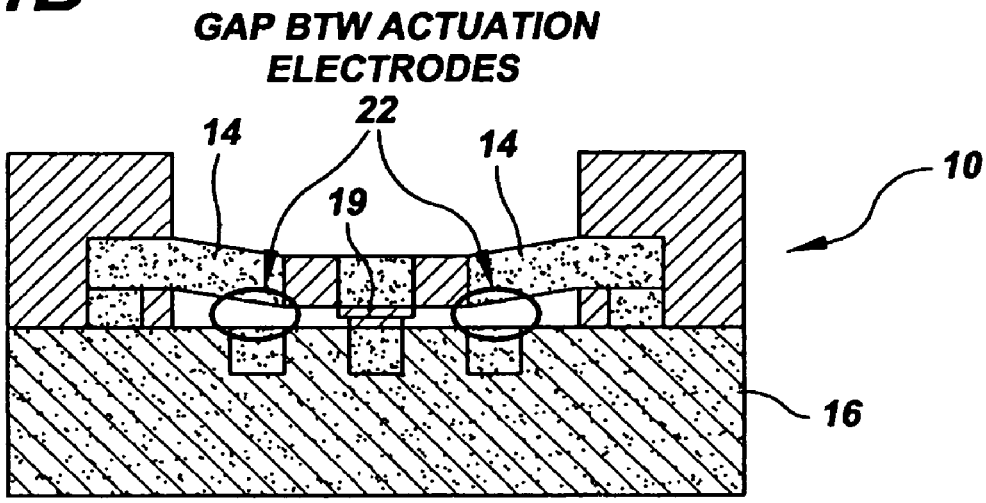
FIG. 1B depicts the MEMS relay of FIG. 1A with the relay show in a CLOSED or ACTIVATED state.

FIG. 1A depicts a MEMS relay 10 in the OPEN state having switch electrodes 12 and actuation electrodes 14. The MEMS relay 10 is configured on a silicon substrate 16. The switch electrodes are electrically isolated from the actuation electrodes by an inter-dielectric layer (ILD) 18. Contacts 19 are situated on upper and lower faces of the switch electrodes. FIG. 1B depicts the MEMS relay 10 of FIG. 1A with the relay show in a CLOSED or ACTIVATED state. This occurs when the switch is supplied with an actuation voltage. Contacts 19 are shown in electrical contact, while the actuation electrodes 14 are held close together but remain spaced apart between gaps 22 during the actuation period. By applying an actuation voltage, the switch beam is brought into physical contact with the lower contact pad by an electrostatic force. The applied actuation voltage is called the pull-in voltage because the beam is physically pulled down to the lower contact.

The objective is to test certain characteristic parameters on these relays in order to ascertain functionality during the entire design lifetime of the switches. These parameters include: pull-in and drop-out voltage; leakage current drawn by the actuation; resistance of the contacts; and the number of actuations (OPEN/CLOSE) before sticking. For example, unlike traditional BEOL structures where metal lines are imbedded in rigid insulating dielectrics, MEMS switches usually involve free-standing structures, such as cantilevers, fixed-fixed beams, or suspended bridge structures, that move in response to electrostatic forces from an applied voltage to the actuation components. At the application of the actuation voltage, the switch electrode contacts on the cantilever/beam make contact with the lower contact pads for electrical transmission, while the actuation electrodes remain separated by a narrow gap, as shown in FIG. 1B. In the event that the actuation electrodes inadvertently make contact with each other during switching, the actuation voltage is interrupted and the switch may be opened unintentionally. Consequently, it is important to evaluate the gap separation by measuring the leakage current between the actuation electrodes when the switch is in the CLOSED state to ensure proper switching. Performing an evaluation of the gap separation requires having an area of interest as large as possible, so that the potential problem at the gap interface can be amplified and observed. One of the testing challenges is the simulation of the actuation while conducting the leakage current measurement in the gap area. Test structures are proposed that allow for this measurement with greatly exaggerated switch electrode and actuation electrode areas.

The total leakage current and total contact resistance of the entire population may be simultaneously measured, making the magnitude of the parameter measurements easier to obtain with more accuracy, which ultimately improves the value of the qualification process. Similarly, the change in total leakage current and contact resistance may be measured over the useful life of the switch population in order to ensure that these parameters stay within the design tolerance over the entire life of operation.

In addition, both the pull-in and drop-out voltage of each individual switch can be accurately measured, yielding a distribution of these and other important parameters for the entire population. A change in this distribution may be measured as a function of age or number of switch actions. Thus, it is important for the switches to be tested beyond the operational life by employing accelerated stress condition. Both OPEN and CLOSED conditions may be detected, but importantly, these conditions do not disable the test structure, so measurements may be continued until each and every switch in the test structure no longer functions, yielding a distribution of switch lifetime.

Method and Structure for Testing Contact and Gap Characteristics

Figure 2:
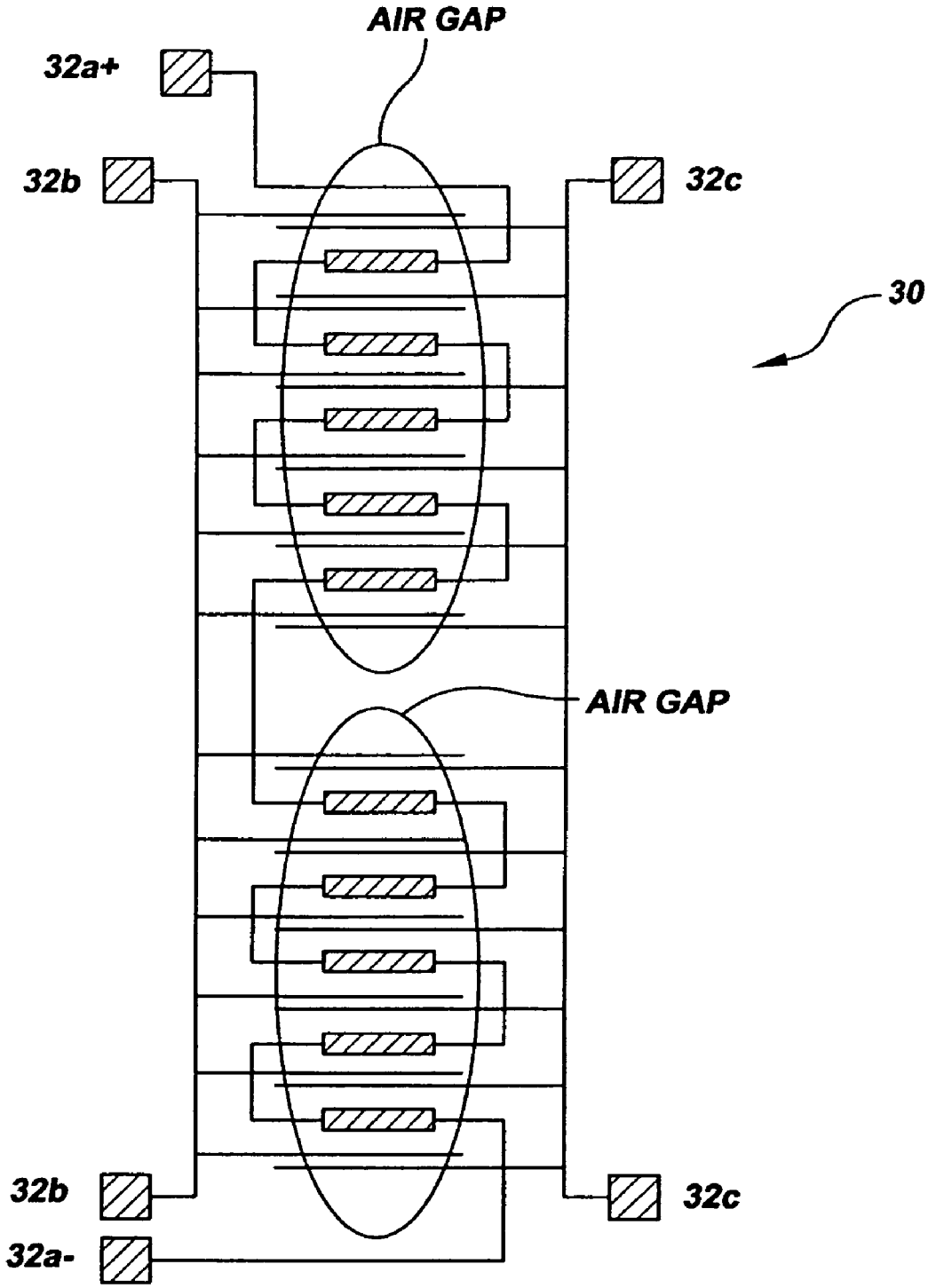
FIG. 2 schematically depicts a structure for the reliability testing and characterization of RF MEMS switches.

FIG. 2 schematically depicts a structure 30 for testing RF MEMS switch characterization. This exemplary structure has three sets of probe pads 32*a-c*, required for a full set of measurements. Probe pads 32*b* and 32*c* connect to combs that simulate rows of upper and lower actuation electrodes, respectively. Probe pads 32*a*+ and 32*a*− connect to a serpentine circuit, which is formed about several switches electrically connected in series. In the current embodiment, ten (10) switches are depicted. In a measurement sequence, a test switch is closed by applying an actuation voltage, typically below 10 volts, to the actuation electrodes, between electrodes 32*b* and 32*c*. In this manner, all actuation contacts are in parallel, while the switches are placed in series. Thus, only four switch pad connections are needed for multiple switches—ten in the exemplary embodiment, although other larger numbers are certainly possible with this test structure. A current is then transmitted through the switches in series between probe pads 32*a*+ and 32*a*−. All switches are arranged to close in a series fashion. The switch contact resistances are then measured in-situ by continuous measurement of the resistances between probe pads 32*a*+ and 32*a*−. Thus, the sum of the total contact resistance may be measured, which will be an order of magnitude larger than an individual contact resistance measurement. The total actuation leakage current flows from pad 32*b* to pad 32*c*, and is a magnitude larger due to the parallel connection of the actuation structures. This enables a small leakage current to be measured more accurately. End-of-life measurements are assessed by a switch's failure to close. With all switches in series, it becomes necessary for all switches to close in order to propagate an electrical signal.

Figure 3:
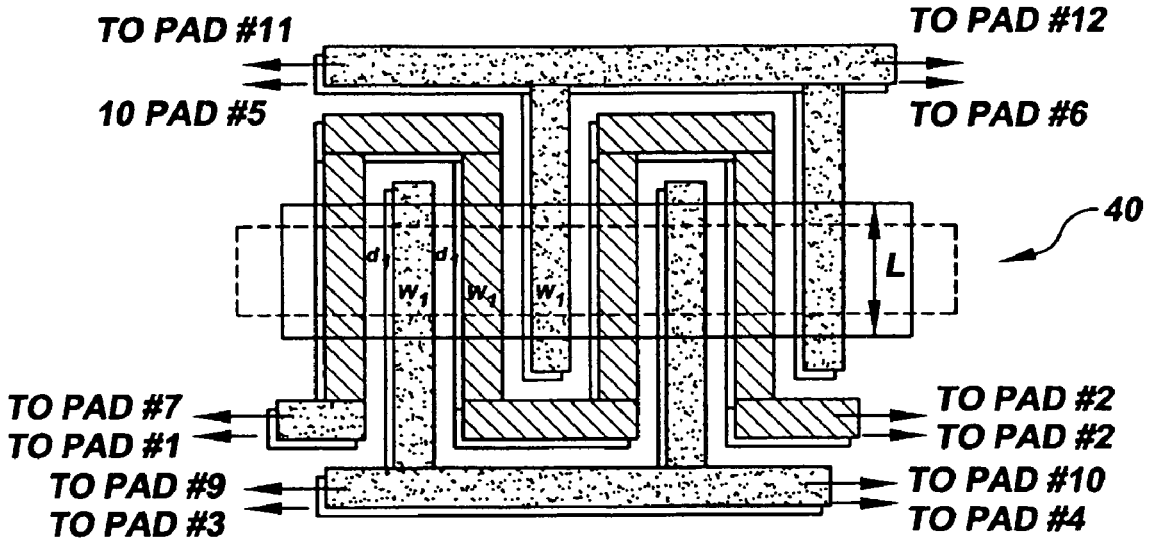
FIG. 3 depicts the actual layout of the preferred embodiment shown in FIG. 2 for testing contact and gap characteristics.

FIG. 3 depicts a layout of the preferred embodiment 40 for testing contact and gap characteristics. In this structure, the contact and gap characteristics are empirically defined as a function of the width and length of the electrodes. The serpentine pattern of the electrodes allows for multiple switches to be formed within the framework of a condensed footprint. The governing features include the width $W_1$ of the electrodes, the gap $d_1$ between each electrode segment, and the length L of the switching area. The width $W_1$ is preferably on the order of 5 μm to 15 μm. The electrodes are shown in layered segments, one over the other, to further compact the structure. The preferred structure has advantage over a traditional discrete structure for device characterization and reliability testing of a MEMS switch contact, significantly of advantage when large sample sizes are required. The preferred structure reduces the space requirement on a chip, and increases the number of samples that the test system can handle. The dielectric properties may also be characterized when the switch is closed. However, switch contact or stiction is not studied by this structure. Note that in the preferred test system, the switches remain closed during the entire testing, and thus stiction problems, if any, cannot be identified.

By utilizing the test structure of FIGS. 2 and 3, switch actuations are placed in parallel, increasing the total leakage current, which makes this current readily measurable. Likewise, switches are placed in series so that their resistance adds. If all switches are approximately identical, the actuation current and switch resistance will be increase by a factor of the number of switches used. In the exemplary embodiment, it would be a factor of at least one magnitude. In this manner, the test structure can empirically quantify with accuracy small amounts of current and/or resistance.

Cascaded Switch Chain

Figure 4A:
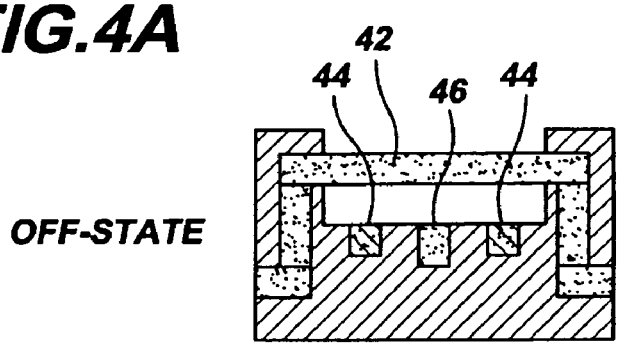
FIG. 4A depicts a schematic diagram of a MEMS switch having a copper cantilever or beam in an OFF-STATE or OPEN position, suspended across the bias lines and the signal line.
Figure 4B:
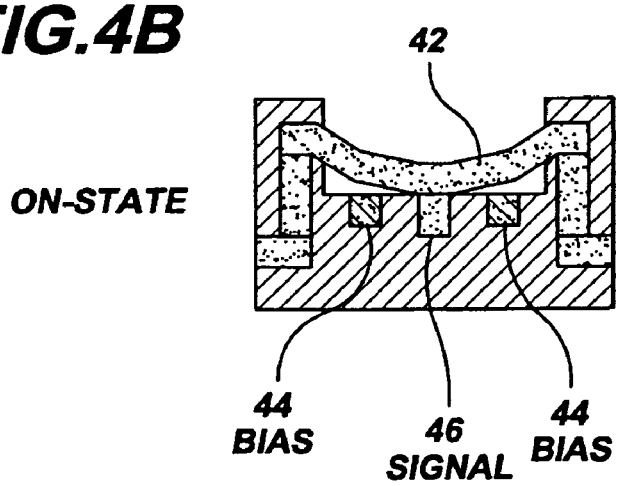
FIG. 4B depicts the copper cantilever switch of FIG. 4A in an ON-STATE or CLOSED position.

MEMS structures continue to be considered by persons of skill in the art as possible switch structures in advanced high performance analog circuitry, due mainly to their improved switching characteristics over FET devices. Typically, thick copper metal is used as the switching beam or cantilever, as shown schematically in FIG. 4. FIG. 4A depicts a schematic diagram of a MEMS switch having a copper cantilever 42 in an OFF-STATE or OPEN position, suspended across the bias lines 44 and the signal line 46. Cantilever 42 is pulled down by applying a bias voltage through bias lines 44. FIG. 4B depicts the copper cantilever switch of FIG. 4A in an ON-STATE or CLOSED position. In the ON-STATE position, cantilever 42 contacts signal line 46 for transmitted RF and/or DC signals.

The performance and reliability of the MEMS switch structure depend critically on the choice of material and size. For example, the pull-down voltage and switching speed depend mainly on the mechanical properties of the cantilever material, as well as the dimensions of the beam. In the preferred embodiments, the device structures are allowed the use of shorter beams. This poses less of a stiction problem while adding more reliability, and exhibits reduced switching speed frequency, which can be used to provide proper time delay for switching in certain circuits.

Reliability measures associated with MEMS structures, such as fatigue, contact integrity, and stiction, are unique among conventional BEOL structures. A cascaded switch chain test structure is proposed to evaluate process yield, performance, and reliability. This test chain structure has been shown to greatly increase the sample size for testing and parameter/device characterization, including allowing easier, more accurate measurement of switching speed. The preferred cascaded switch chain embodiment offers flexible switch design and precise switching speed measurements. The cascade switch chain is also used as a test structure for evaluating yield performance and reliability of a MEMS switch. With the addition of inverters, edge counters, and frequency counters, the cascade switch chain structure may be modified to serve as a ring oscillator for automated lifetime measurement and precise switch speed characterization.

Figure 5:
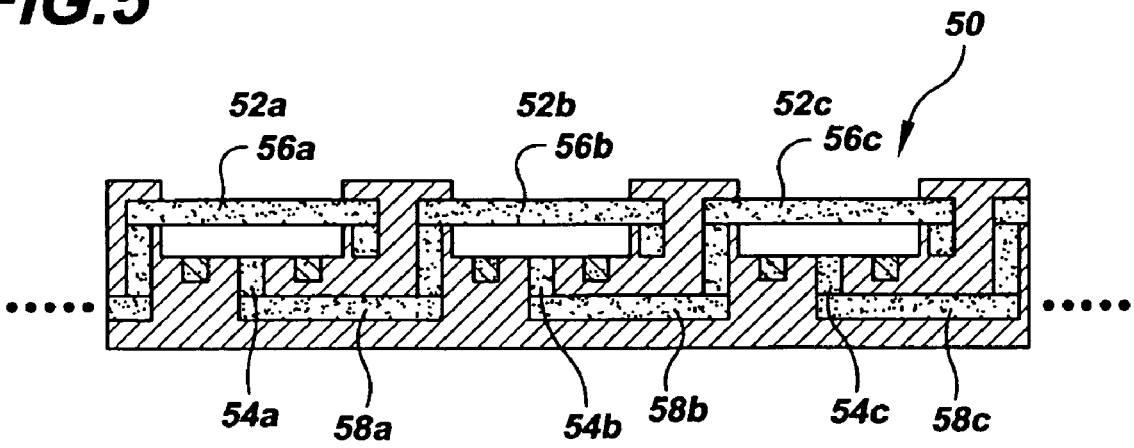
FIG. 5 depicts the cascade switch chain of the present invention showing multiple switches.
Figure 6:
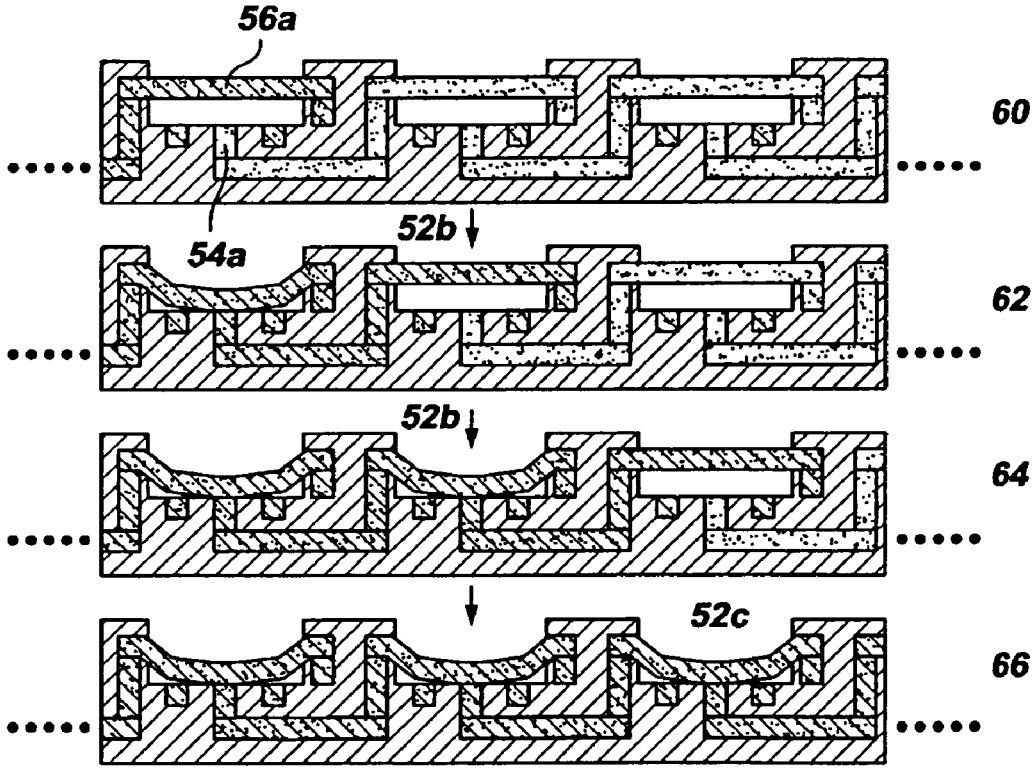
FIG. 6 schematically represents employing the cascade switch chain of FIG. 5.

FIG. 5 depicts the cascade switch chain 50 of the present invention showing multiple switches 52*a-c*. Each switch has a signal line 54*a-c*, a beam 56*a-c*, and associated via connections 58*a-c*, respectively. Signal line 54*a* of the first switch is connected through via 58*a* to beam 56*b* of second switch 52*b*. Similar electrical connections are made from one switch to another. In this manner, a large number of switches are linked to form a chain structure. FIG. 6 schematically represents how the cascade switch chain of FIG. 5 is employed. Before biasing, each switch is electrically isolated from others in the chain. As depicted in row 60, upon biasing beam 56*a* of the first switch 52*a*, beam 56*a* is pulled down and contacts signal line 54*a* of the first switch. The close of switch 52*a* induces the biasing of switch 52*b* as depicted in row 62. This in turn closes switch 52*b*, shown in row 64, biasing switch 52*c*, and so on. The rows of FIG. 6 schematically demonstrate the cascading effect of the switch biasing. Since the entire chain closes only when all the individual switches are closed, the cascade chain may be used for monitoring process defects with a large sample size. Furthermore, the switching time of the entire chain is the summation of the switching time for each switch. As a result, this cascade chain structure may be used to determine the characteristic switching speed of switches that have different dimensions and/or materials. The lifetime and reliability measures may also be evaluated with large sample sizes at high statistical confidence levels.

In addition, it is possible for the preferred cascade switch embodiment to function as a switch with specified switch delay characteristics for certain circuit applications. By increasing the total number of switches in the chain, the switch time can be properly delayed to match the time characteristics required for a given operation.

Cascade Switch Ring Oscillator

Figure 7:
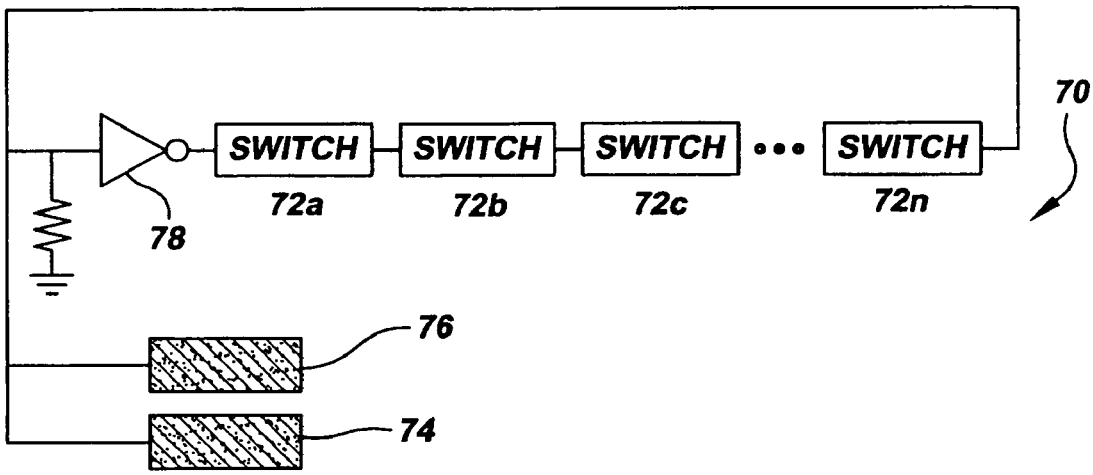
FIG. 7 depicts a ring oscillator arrangement of cascade switches for measuring switch speed and switch lifetime.

FIG. 7 depicts a ring oscillator 70 arranged of cascade switches 72*a-n*. The ring oscillator is useful in measuring switch speed and switch lifetime. A frequency measurement, typically performed by a frequency counter 74, and multiple switches 72*a-n* in the ring oscillator, yield a measurement for switch delay of 1/f*N, where f is the frequency and N is the number of switches. An edge counter 76 counts the rising and falling edges of the signal on each pass-through allowing the number of switch actions to be quantifiable. An inverter 78 closes the switches. The signal then circles back and reopens them. In this manner, the switches are closed sequentially, not simultaneously. A frequency counter 74 is used to measure the delay time, measuring frequency as a function of the number of edges. If the ring oscillator is operated until failure, the total number counted (total number of switch actions) correlates to the switch lifetime. The delay time is used in conjunction with the number of cycles to quantify the switch's performance characteristics over its lifetime.

Pull-in and drop-out voltage levels are measured and verified by observing the presence or disappearance of the frequency signal when the actuation voltage is ramped up or down, respectively. The measured voltages represent the worst-case performance of the switch population, yielding the highest pull-in voltage and lowest drop-out voltage, because all switches must be functioning for the ring oscillator to operate.

Figure 8:
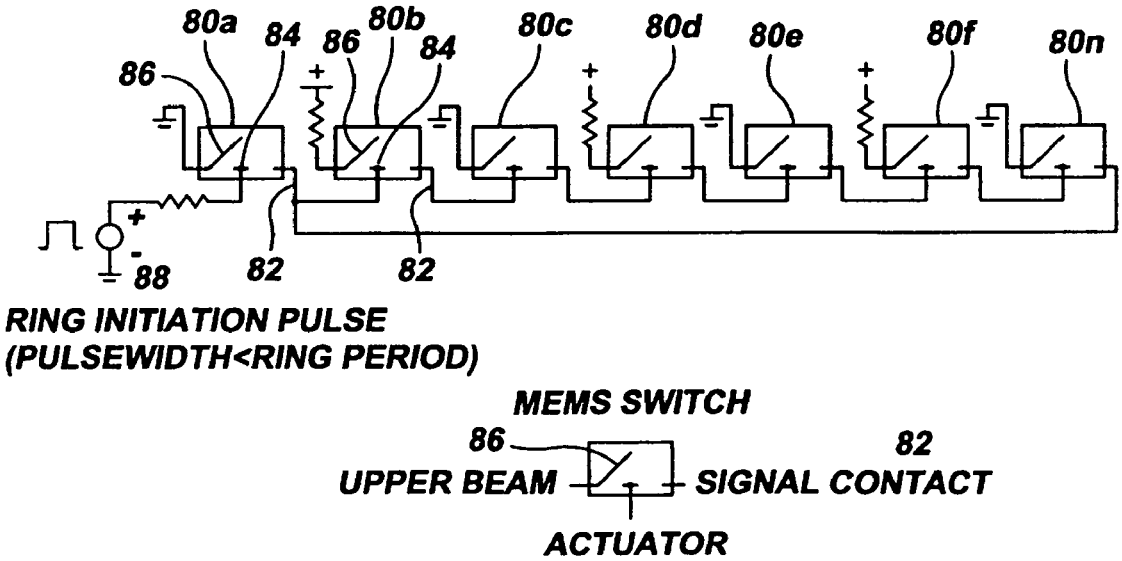
FIG. 8 depicts a second embodiment for a ring oscillator testing multiple MEMS switches.

FIG. 8 depicts a second embodiment for a ring oscillator. This second arrangement does not require any active circuits, such as inverters, to maintain oscillation. The configuration is useful in situations where a MEMS circuit is realized on a substrate where no active device processing has been performed. As shown in FIG. 8, MEMS switches 80*a-n* are electrically connected in a cascading fashion with signal contacts 82 and actuator contacts 84 acting on upper beam 86. In this configuration, the pulse width of the ring initiation pulse 88 is less than the ring period.

Resistor Ladder Test Structures

Figure 9:
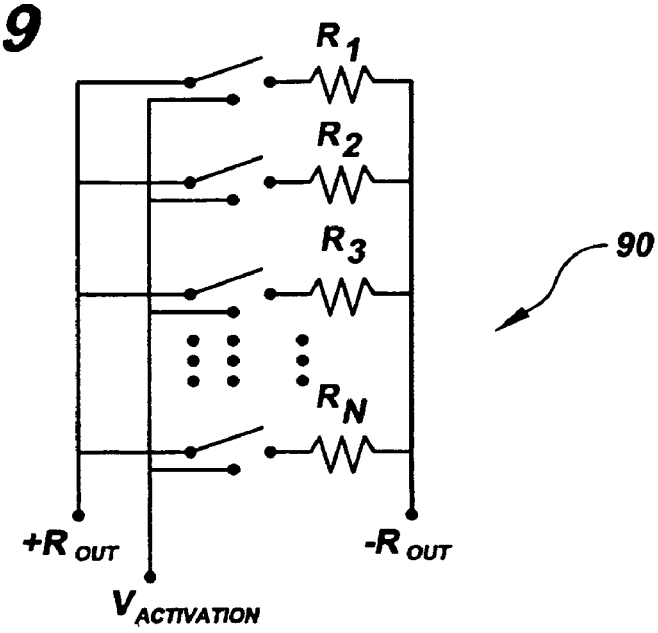
FIG. 9 depicts an electrical schematic of the preferred embodiment for a resistor ladder test structure.

FIG. 9 depicts an electrical schematic of the preferred embodiment for a resistor ladder test structure 90. Resistors $R_{1\text{-}N}$ are shown, each in series with a switch to be tested, having each switch-resistor pair electrically connected in parallel. In this manner, all of the switches are activated together. Consequently, for N switches only four probe pads are required as shown. As the activation voltage is slowly stepped up, the switches close, one by one, and the resistance at the $R_{out}$ terminals decreases in a predictable, predetermined manner for each closing switch. Resistance $R_{out}$ is a function of the number of switches that are closed. As the activation voltage is slowly decreased, the switches open, one by one, and resistance across the $R_{out}$ terminals increases in a similarly predictable manner. By employing this embodiment, a distribution of the pull-in voltage and drop-out voltage may be plotted for an entire population of switches. The switches are then exercised for a predetermined number of actions, and the process is repeated to determine the change in the voltage distributions as a function of the life of the switch.

Additionally, resistance measurement at the $R_{out}$ terminals is capable of indicating a stuck-switch condition. If the resistance is too low when no activation voltage is applied, this indicates that at least one switch is in a closed position. The measured value of the total resistance will empirically show how many switches are in a closed position. Similarly, if maximum activation voltage is applied and resistance $R_{out}$ is too high, the resistance will indicate how may switches are in an open position. Importantly, testing may continue even after some switches have been brought to failure. Furthermore, testing may continue until all switches have failed, when no resistance change at $R_{out}$ is measured when the activation voltage is changed from zero to its maximum value. In this manner, the resistor ladder test structure is capable of yielding a distribution of switch lifetimes.

The preferred resistor ladder test structure is useful at both early and late points in the product qualification process. In the early stages, when the manufacturing process is not yet mature, it is useful to perform physical failure analysis on failed parts. This requires a failed switch to be precisely identified when the failure is detected. The preferred resistor ladder test structure technique accomplishes this by requiring each of the resistors in the ladder structure to have different values. The number of switches in the ladder also facilitates measuring and identifying specific switch failures. Preferably, ten to twenty switches per ladder are suitable for identifying specific switches upon failure, although the test structure may accommodate many more switches. When the manufacturing process has matured to a level where failure analysis of individual switches is no longer required, it becomes important for the test engineer to know how many switches have failed, and to be able to assign a statistically significant statement to the switch success rate. In this instance, many more switches may be built into the ladder structure, preferably 100 to 200 switches. An identical resistor is assigned for each switch. The number of closed switches is quantitatively defined by $R/R_{out}$, where R is the resistance of one of the identical ladder resistors. This method allows the measurement of more accurate distributions of switch pull-in and drop-out voltages, and lifecycle assessment, due to the availability of the large number of switches in the structure.

Serial/Parallel Structures

Figure 10:
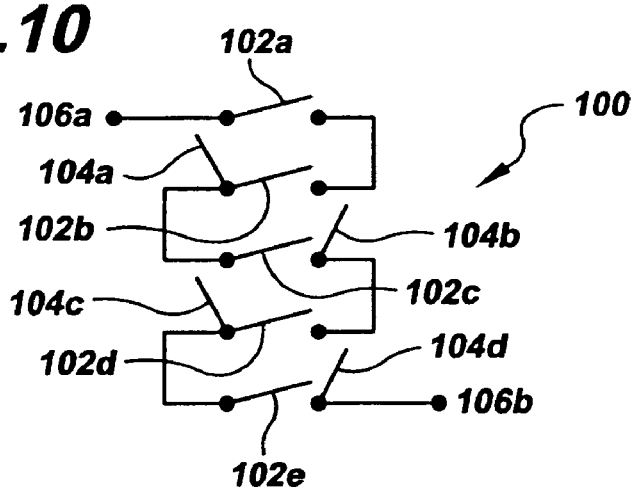
FIG. 10 depicts a schematic of a general configuration of serial/parallel structures for MEMS switch testing.

FIG. 10 depicts a schematic of a general configuration 100 of serial/parallel structures for switch testing. Switches 102*a-e* represent the devices to be tested. Switches 104*a-d* are comprised of an established technology, such as solid state devices. In this embodiment, there can be any number of tested devices. Two probe pads 106*a,b* are shown. For clarity, activation probe pad pairs for switches 102 and 104 are not shown; however, they make for a total of six probe pads for the Serial/Parallel test structure, regardless of the number of switches 102 being tested.

Figure 11:
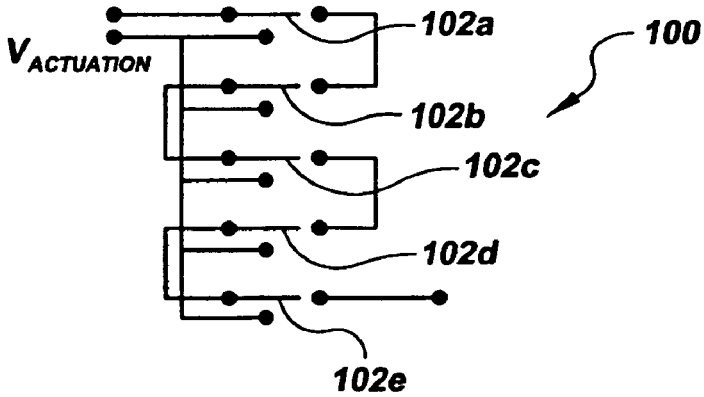
FIG. 11 depicts the MEMS switches of FIG. 10 connected in series within the serial/parallel structure.

Switches 102, when closed, are electrically connected in series if switches 104 are simultaneously open. FIG. 11 depicts the switches of FIG. 10 connected in series. Switches 102 will all activate simultaneously, so that the activation leakage current of the entire structure is the sum total of each individual switch leakage current. The series arrangement of the contacts ensures that the contact resistance of the entire structure is the sum total of the contact resistance of all the individual switches. The activation voltage may then be slowly increased to measure the pull-in voltage, and slowly decreased to measure the drop-out voltage. Any switch that fails in the OPEN-STATE will cause the structure to fail; however, any switch stuck closed will not be detected.

Figure 12:
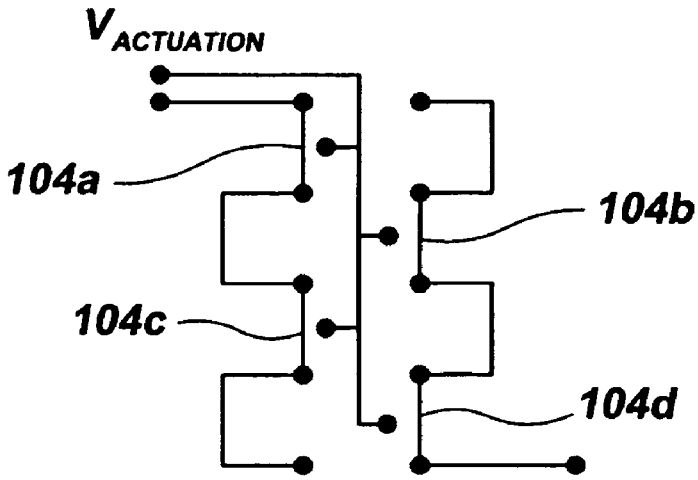
FIG. 12 depicts the serial/parallel structure of FIG. 10 with MEMS switches closed.

FIG. 12 depicts serial/parallel structures of FIG. 10 with switches 104 closed. In this manner, the contacts of switches 102 are in parallel. This configuration is used to detect switches that are failed in the CLOSED STATE.

A preferred method of operation of the serial/parallel structure is as follows: 1) exercise switches 102 for a defined number of actions; 2) measure activation leakage current, contact resistance, pull-in voltage, and drop-out voltage; 3) use switches 104 to check for any failures of switches 102 (open or closed state failures); and 4) repeat steps 1-3 above until failures are detected in switches 102.

Shift Register Structure

Figure 13:
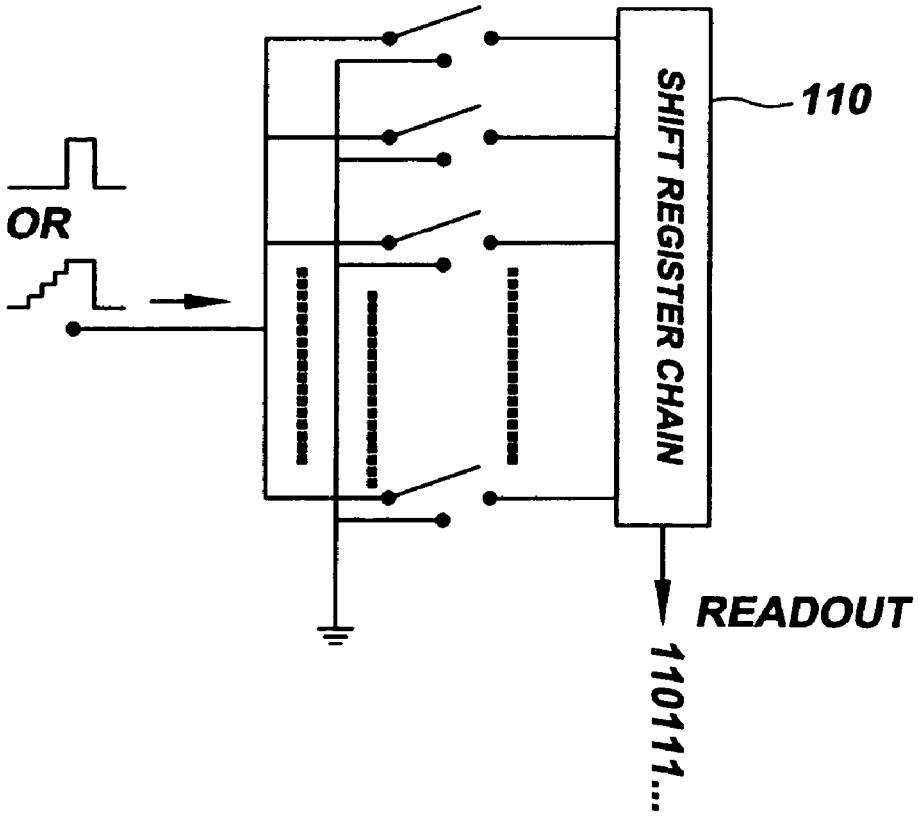
FIG. 13 depicts a shift register structure reflecting the OPEN or CLOSED state of the MEMS switches during switch testing.

In general, the present invention involves different methods and structures for increasing the sample size of MEMS switches with a limited number of I/O pads. Another embodiment which may be employed towards this end is a shift register. FIG. 13 depicts a shift register 110 reflecting the OPEN or CLOSED state of the MEMS switch. This embodiment allows all of the switch activations to be tied together, so that only two chip pads are required regardless of the number of MEMS switches being evaluated. The shift register chain requires a clock input, a data input, and a data output. Statistics are gathered over a large population of devices with a small number of I/O chip pads. The OPEN/CLOSE state of each individual switch may be determined at any time by shifting out the register contents for analysis. Generally, the MEMS circuits are fabricated in the upper wiring layers. As such, they may physically reside above the shift register, allowing more space for additional test circuits.

Referring to FIG. 13, the shift register structure is useful in many ways for gathering statistics on the behavior of a large population of MEMS switches, including applying statistical calculations for pull-in voltage, drop-out voltage, activation leakage current, and lifetime.

For pull-in voltage, if the actuation voltage is slowly increased in small, discrete steeps, and a readout of the shift register is performed after each step, the activation voltage of each individual switch may be measured. The number of CLOSED switches may be counted by counting the number of 1's in the shift register chain. By plotting the number of closed switches against the applied actuation voltage, a histogram may be formed of the actuation voltages of the entire population. Moreover, since each cell of the shift register corresponds to a MEMS switch, physical failure analysis may be performed on any switches that fail to operate, or whose actuation voltage is no longer within specification.

For drop-out voltage, a similar activity is performed using the shift register structure; however, the applied actuation voltage is stepped down rather than increased, and the number of OPENED switches is counted.

For activation leakage current, since all of the activation contacts of all the switches are in parallel, the current drawn by the activation pads of the test structure is the sum total of the activation leakage of all active devices. The average leakage current may be calculated from the total leakage current measured divided by the number of CLOSED switches. Furthermore, a graph of the total leakage current against the number of CLOSED switches can be matched against a linear plot since this the linearity indicates uniformity of the actuation structures.

Lifetime measurements are derived from the number of actuations to physical failure of the MEMS device. The shift register structure may be used to indicate switches that do not close when the actuation voltage is applied or switches that remain closed when the actuation current is removed. The number and mode of failure may be plotted as a function of the number of actuation voltage pulses applied. This yields a histogram of the lifetime of the population of switches.

The present invention provides multiple test structures for performing reliability and qualification tests on MEMS switch devices. A test structure for contact and gap characteristic measurements having a serpentine layout simulates rows of upper and lower actuation electrodes. MEMS switches are electrically connected in series. A cascaded switch chain test is used to monitor process defects with large sample sizes. The entire chain closes only when all the individual switches are closed. The cascaded switch chain test will determine the characteristic switching speed of switches that have different dimensions and/or materials. With the addition of inverters, edge counters, and frequency counters, the cascade switch chain structure may be modified to serve as a ring oscillator. The ring oscillator is used to measure switch speed and switch lifetime. A resistor ladder test structure is configured having each resistor in series with a switch to be tested, and having each switch-resistor pair electrically connected in parallel. Pull-in voltage and drop-out voltages may be plotted for an entire population of switches. Serial/parallel test structures are proposed with MEMS switches working in tandem with switches of established technology. MEMS switches can be tested in series and in parallel. A shift register is used to monitor the open and close state of the MEMS switches. Pull-in voltage, drop-out voltage, activation leakage current, and switch lifetime measurements are performed using the shift register.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for measuring contact and gap characteristics of MEMS switches comprising:

a plurality of said MEMS switches in an array pattern configured in a circuit, having air gaps between combs of upper and lower actuation electrodes;

a first pair of probe pads electrically connecting to said upper actuation electrodes;

a second pair of probe pads electrically connecting to said lower actuation electrodes; and a third pair of probe pads electrically connecting to said MEMS switches in said circuit;

such that all of said actuation electrodes are electrically configured in parallel, while said MEMS switches are electrically configured in series, allowing said actuation electrodes to close simultaneously to measure a total actuation leakage current.

2. An apparatus for measuring contact and gap characteristics of MEMS switches comprising:

a plurality of said MEMS switches in an array pattern configured in a circuit, having air gaps between combs of upper and lower actuation electrodes;

a first pair of probe pads electrically connecting to said upper actuation electrodes;

a second pair of probe pads electrically connecting to said lower actuation electrodes;

a third pair of probe pads electrically connecting to said MEMS switches in said circuit;

such that all of said actuation electrodes are electrically configured in parallel, while said MEMS switches are electrically configured in series; and switch contacts of said MEMS switches arranged such that said MEMS switches close in series and said actuation electrodes in parallel so that an actuation leakage current which is a sum total of each individual actuation leakage current of each of said MEMS switches is measurable, or a contact resistance which is a sum total of each individual contact resistance of each of said MEMS switches is measurable.

3. The apparatus of claim 2 wherein said electrodes are placed in layered segments one over the other to form a compact structure for reducing a size of the apparatus for measuring contact and gap characteristics of MEMS switches.

* * * * *

UNITED STATES PATENT AND TRADEMARK OFFICE

CERTIFICATE OF CORRECTION

PATENT NO. : 7,602,265 B2
APPLICATION NO. : 11/163485
DATED : October 13, 2009
INVENTOR(S) : Deligianni et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 766 days.

Signed and Sealed this

Fifth Day of October, 2010

David J. Kappos

David J. Kappos
*Director of the United States Patent and Trademark Office*